United States Patent [19]

Lodge

[11] 4,072,187

[45] Feb. 7, 1978

[54] COMPACT HEATING AND COOLING SYSTEM

[75] Inventor: Robert H. Lodge, Los Angeles, Calif.

[73] Assignee: Advance Machine Corporation, Los Angeles, Calif.

[21] Appl. No.: 684,999

[22] Filed: May 10, 1976

[51] Int. Cl.[2] ..... F24D 13/04; F24F 1/02; F24F 11/02; F24H 9/08

[52] U.S. Cl. ..... 165/48; 165/54; 165/59; 165/78; 165/137; 312/236

[58] Field of Search ..... 165/137, 48, 54, 76, 165/78, 50, 59; 312/236

[56] References Cited

U.S. PATENT DOCUMENTS

| | | | |
|---|---|---|---|
| 3,012,762 | 12/1961 | Norris | 165/137 X |
| 3,194,305 | 7/1965 | Moore | 165/137 X |
| 3,366,169 | 1/1968 | Laing | 165/48 |
| 3,449,838 | 6/1969 | Chancellor, Jr. | 312/236 |
| 3,678,993 | 7/1972 | Pierce | 165/137 X |
| 3,749,157 | 7/1973 | Davison | 165/137 X |
| 3,908,750 | 9/1975 | Siegel | 165/78 |
| 3,977,467 | 8/1976 | Northrup, Jr. | 165/137 X |
| 4,013,120 | 3/1977 | Rheinheimer | 165/48 |

*Primary Examiner*—Charles J. Myhre
*Assistant Examiner*—Sheldon Richter
*Attorney, Agent, or Firm*—Warren T. Jessup

[57] ABSTRACT

A compact indoor environmental control system which has cooling, heating, and ventilation components mounted and positioned to provide a slim design for in-the-wall installation. A cabinet is provided with cooling and heating components mounted to leave plenums at opposite ends of the cabinet so that air outlets can be selected on any one of five sides of the plenums. The heating, cooling and control sections are of modular design to permit full accessibilty for maintenance, repair or replacement. A variety of configurations for intake and exhaust of inside and outside air are possible because of the versatility provided by the modular construction.

5 Claims, 18 Drawing Figures

COMPACT HEATING AND COOLING SYSTEM

BACKGROUND OF THE INVENTION

This invention relates generally to environmental control systems and more particularly relates to a heating and cooling and ventilation unit which provides maximum versatility for installation in building constructions.

Heating and cooling systems have been generally of different design when installed in different areas of buildings, homes, or apartments. Some units require a large closet with complex ducting systems and consequently are bulky and expensive to install. Other units are designed to be free-standing parallel to a wall with the venting and mounting of components designed specifically to permit venting only from this particular installation. There are also heating units for installation in walls, but generally they can only be installed in one particular way with vent selection for flow of air into and out of the system being limited to the particular installation.

In addition to the necessity to design separate units for different installations, the repair and maintainance of these units is generally difficult because the components are not readily accessible without substantially disassembling of the system. That is, each part of the cooling and heating system is separately bolted or fastened into the system and sometimes one must be removed to have accessibility to another, such as a blower needing to be removed to get at the heating coils or condensing coils for example. The present invention overcomes these difficulties while providing a maximum of versatility.

SUMMARY OF THE INVENTION

The purpose of the present invention is to provide an environmental control system which is adaptable to many different uses without any necessity for repositioning, remounting or redesigning components.

The significant features of this invention are its universal adaptability in that it provides an elongate thin cabinet having intake and exhaust plenums at the top, bottom and middle, providing access from all five sides to the top and bottom plenums and four sides with the middle plenum. In addition, the system provides for modular design of the cooling, heating and control sections so that they may be easily removed from the cabinet and repaired. The heating, cooling and control modules are slideably mounted in the cabinet between the intake and exhaust plenums in the top, bottom and center of the elongate thin cabinet.

The present invention is comprised of an elongated thin housing or cabinet having cooling and heating units internally mounted to leave plenums or cavities at opposite ends of the cabinets so that any one of five sides can be selected for exhausting of outside air drawn through the unit. The mounting and arrangement of components in the cabinet is engineered to permit maximum versatility in the selection of intake and exhaust vents from outside air as well as inside air from one or more rooms. The components are mounted to provide a centrally located cavity which is separated by a partition, with one cavity for drawing outside air and the other cavity for drawing and circulating inside air.

In addition to maximizing versatility of use, the system provides additional versatility in repair and maintenance by providing the cooling and heating units in readily removable modules for ease of access to each of the components of the separate systems. In addition a control panel or control module is also separately removable from the housing and is fitted into a cavity between the respective heating and cooling units. Electrical connections are provided by plugs on the control module.

The arrangement and mounting of components permits the device to be mounted free-standing parallel to a wall, completely within a wall, through-wall installation for controlling temperature of more than a single room, and integrated into the wall partition for drawing of outside air through side vents.

It is one object of the present invention to provide an environmental control system which provides a maximum versatility for installation.

Another object of the present invention is to provide an environmental control system which simplifies repair and maintenance.

Other objects, advantages and novel features of the invention will become apparent from the following detailed description of the invention, when considered in conjunction with the accompanying drawings, wherein like reference numbers identify like parts throughout.

DETAILED DESCRIPTION OF THE PREFERRED EMBODIMENT

Figure 1:
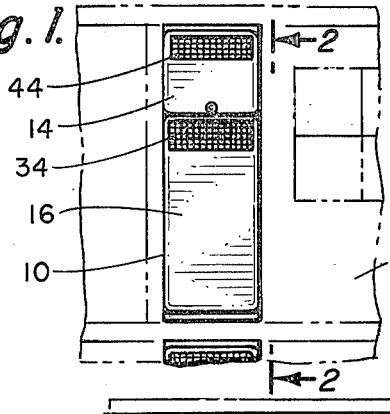
FIG. 1 is a front view of the system installed in a wall.
Figure 2:
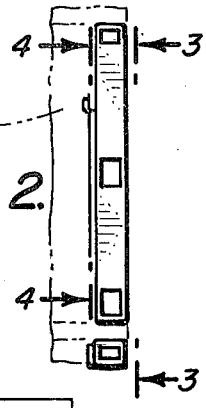
FIG. 2 is a view taken at 2—2 of FIG. 1 illustrating ducting.
Figure 3:
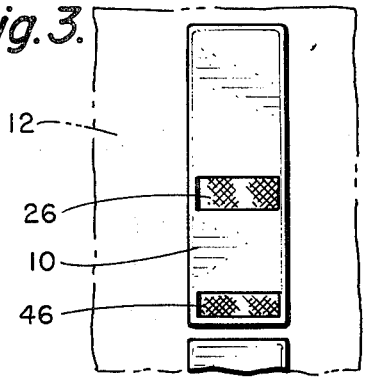
FIG. 3 is a view taken at 3—3 of FIG. 2 illustrating the rear side of the system.

Installation of the environmental control system of this invention is illustrated in FIGS. 1, 2 and 3. The system 10 is designed for installation in an outside wall 12 with the rear portion shown in FIG. 3 for drawing in outside air. These first three drawings illustrate how the slim design of the unit and the arrangement and selection of vents permits integral mounting of units in walls for apartment of multiple-storied building use.

Figure 4:
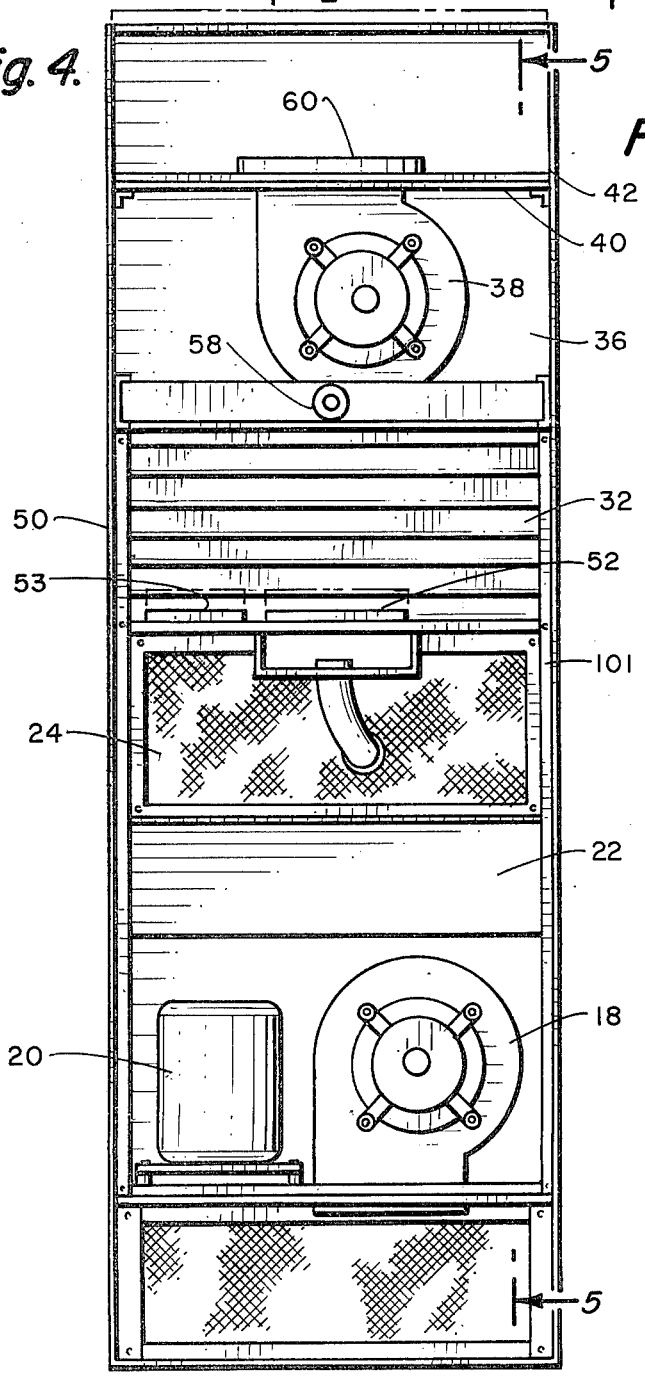
FIG. 4 is a view of the system with the covers removed.
Figure 5:
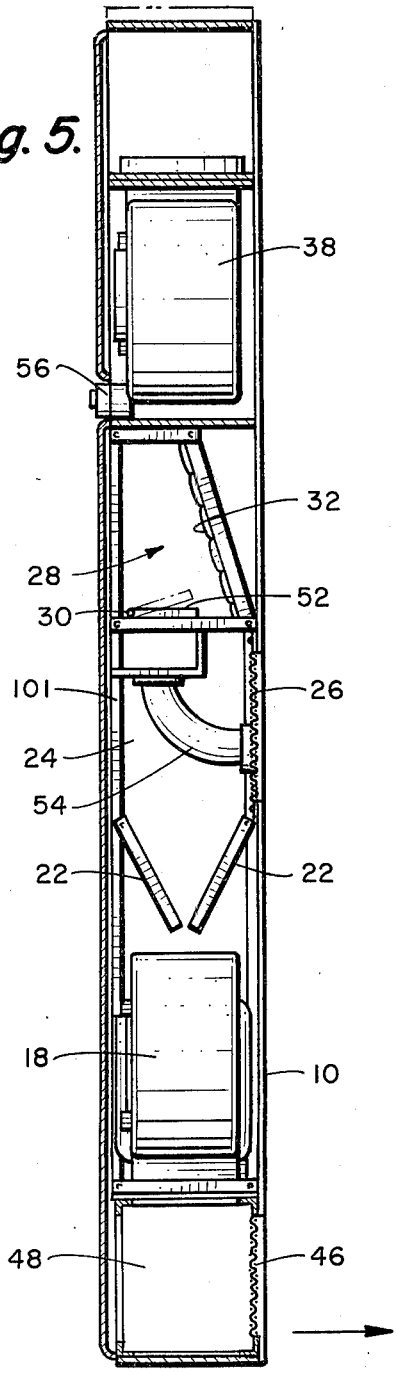
FIG. 5 is a sectional view taken at 5—5 of FIG. 4.

The arrangement and design for mounting of components is shown in FIG. 4 in which the two panels 14 and 16 have been removed to show the internal arrangement of components. The lower section behind panel 16 is the cooling section and is comprised of a blower 18, mounted adjacent to a compressor 20 compressing and circulating coolant. Condensing coils 22 are mounted in a compartment or cavity directly above the blower 18. To fit the condensing coils into the small space of the thickness of a wall, two condensing coils 22 are formed in the shape of a V or horizontal for maximum surface and maximum air processing, as shown in FIG. 5, which is a sectional view taken at 5—5 of FIG. 4. The cavity 24 directly above the condensing coils 22 is for drawing in external air for circulating through the condenser coils 22. The outside vent 26 may have a filter for cleaning the air, if desired.

Inside air is drawn into the system through cavity 28 which is separated from the external air intake cavity or plenum 24 by a partition 30. Mounted in the internal air intake cavity 28 is a cooling coil 32 through which the coolant is circulated after being condensed. The intake cavity or plenum 28 draws its air through a vent 34 in the removable panel 16. The portion of the housing directly above the cooling coils 32 is a cavity 36 in which a blower 38 is provided for circulating conditioned air. The blower 38 is supported on a partition 40 separating the conditioned air circulating plenum 36 from the exhaust plenum 42 through which air is delivered to the room being conditioned through openings at either side of the plenum.

The conditioned air is delivered through a vent 44 in the upper panel 14 from the cavity 42. Air discharged through blower 18 is expelled through vent 46 of lower plenum 48 of the housing 50.

Thus, the housing 50 is divided into seven separate compartments or cavities each housing a separate component or providing a space for intake and exhaust of outside air or conditioned air. The lower cavity 48 is for exhaust of outside air, while the upper cavity 42 is for exhaust of inside conditioned air. The centrally located cavities 24 and 28 are for intake of outside and inside air respectively.

In order to add fresh air to the internal air being circulated through cavity 28 and coolant coils 32, the partition 30 may be provided with a vent or damper 52 which may be set for differing openings to permit selective amounts of outside air to enter through the coolant coils 32, and conditioned air blower 38. The adjustable vent 52 is connected to the exterior vent 26 by a duct 54. This duct 54 maintains the cooling section completely separate from the conditioned air section. Room air can also be discharged or exhausted through a second vent or damper 53. When this vent is open, room air will be drawn down through blower 18 and exhausted through plenum 48.

The cooling section is comprised of the cavities 24, 28 and 48 and the components, condensing coil 22, compressor 20, and blower 18 mounted in compartments between these cavities. The conditioning portion of the system is comprised of cavities 28, 36, and 42 and the components mounted therein. Thus, all the cooling part of the system is mounted below the partition 30 while all the conditioning part of the system is mounted above the partition 30. The control module 56 is mounted between the coolant and conditioning sections to provide for operation of both of these sections through a thermostat 58.

In addition to controlling the cooling of the system, the thermostat 58 also provides control of a heater 60 installed to heat air passing through blower 38. The heater may be a resistance heater which is preferred, or could be a radiator type in which a heated fluid is circulated, if desired. In the alternative, the system comprised of blower 18, compressor 20, condenser 22 and coolant coils 32 can be operated as a heat pump so that coils 32 are performing a reversed function. That is, the coils 32 act as heating coils and the coils 22 act as heat collecting coils, withdrawing heat from the outside air being circulated through the system. The use of a radiator of some type of system for circulating a heated fluid through the heater 60 is not preferred because it would require the connection of external fluid circulating systems which would detract from the purpose of having the system completely self-contained.

Figure 6A:
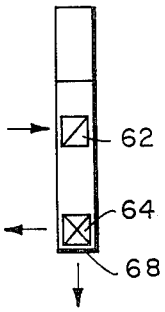
FIGS. 6*a* through 6*c* illustrate the manner in which exterior air may be brought in and discharged from the system.
Figure 6B:
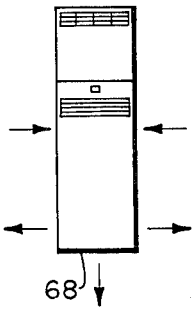
Figure 6C:
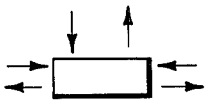
Figure 7A:
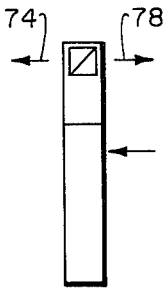
FIGS. 7*a* through 7*c* illustrate the distribution of conditioned air from the cabinet.
Figure 7B:
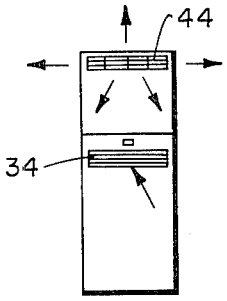

The flexibility of the system in permitting circulation of air with compact, integrated, in-the-wall mounting is illustrated in FIGS. 6 and 7. In FIG. 6*a* circulation through vents 62 and 64 in either side of the system permits a variety of installations. Thus, air can be drawn into the condenser as illustrated in FIG. 6*b* with the air being drawn through the sides rather than through the rear as shown in FIGS. 1 and 3. Also, the air can be discharged through these side vents, if desired, as shown in FIG. 6*b*. FIG. 6*c* shows the six different ways in which air can be circulated through the condensing portion of the system. That is, it can be taken in or discharged from either side or from the rear and in addition in FIGS. 6*a* and 6*b*, air can be discharged through the bottom portion 68, as illustrated by the downwardpointing arrows.

Figure 7C:
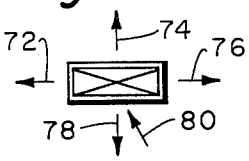

In FIG. 7 the circulation of conditioned air is illustrated. Here air is taken in through vent 34 drawn through the blower 38 and discharged through vent 44. However, since the cavity 42 is at the top of the cabinet, air can be discharged either in front or rear, sides or top, as is illustrated in FIGS. 7*a* and 7*c*, by arrows 72, 74, 76, 78 and 80.

Figure 8A:
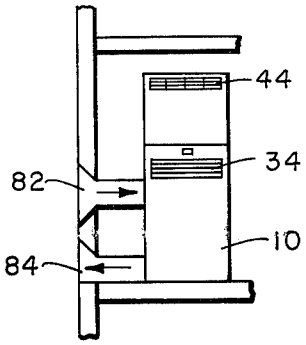
FIGS. 8*a* through 8*f* illustrate a few of the many possible variations permissible for installation of this system.
Figure 8B:
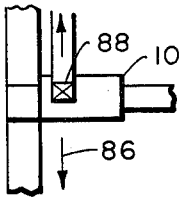

Various methods of installing the system are shown in FIGS. 8*a* through 8*f*. In FIG. 8*a* the system may be installed integrally within a partition wall and connected to an outer wall with ducts which connect side vents 62 and 64, to draw in and discharge outside air. When installed in this fashion the system can be used to condition two rooms with intake 34 and discharge grille 44 being used for one room and a separate grille on the rear of the cabinet behind discharge grille 44 being discharged into an adjacent room. Additionally, the top of the system could be used to heat or cool a second-floor room by merely connecting it to the duct work through the ceiling to a vent. The use of the system shown in FIG. 8*a* for conditioning two rooms is shown in FIG. 8*b* in which air is discharged from vent 44 into the room 86, while vent 88 discharges through a duct to the opposite side.

Figure 8C:
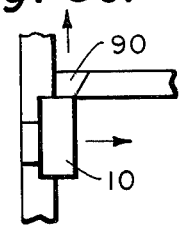

In FIG. 8*c* the system is shown integrated into an outer wall with the rear vents 26 and 46 drawing in and discharging air. When installed in this manner, the top, front, and side of the system can be used to heat or cool one or more rooms as illustrated by the arrows.

Figure 8F:
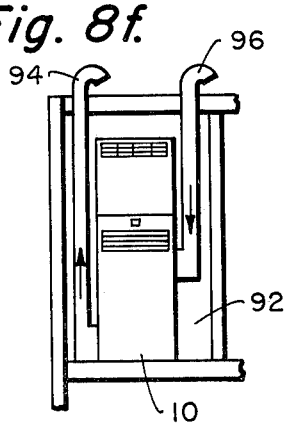
Figure 8E:
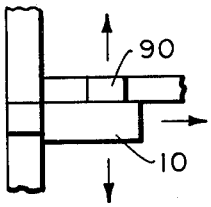
Figure 8D:
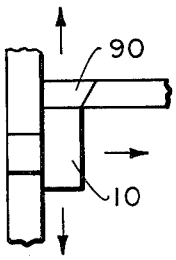

In addition to being integrated in the wall, the compact, slim design of the system permits free-standing installation for conditioning several rooms as shown in FIGS. 8*b* and 8*e*. In FIG. 8*b* the system is free-standing parallel to the wall and is similar to the configuration shown in 8*c* with conditioned air being discharged out of the front vent 44 and the two side vents. In FIG. 8*e*, the system 10 is shown in a free-standing configuration, 90° to an outer wall. In this configuration the side vents 62 and 64 are used to draw in and discharge outside air with selection of vents for conditioned air being either in the front vent 44 or side, rear or top vents are desired.

In addition to being extremely versatile and providing an unmatched flexibility as shown in FIGS. 8*a* through 8*e*, the system can be incorporated into existing buildings with suitable duct work as shown in FIG. 8*f*. In this figure the system 10 is shown installed in an existing closet 92 with duct work 94 and 96 being provided for the intake and exhaust of outside air. In this view the duct work is shown passing through the roof to draw in outside air, but, of course, could be ducted to exhaust through a floor into a crawl space of basement, if desired. The tremendous versatility and flexibility of the system in vent selection permits almost unlimited installations and a variety of applications with no loss of ability to repair and maintain the system because of the modular design.

Figure 9:
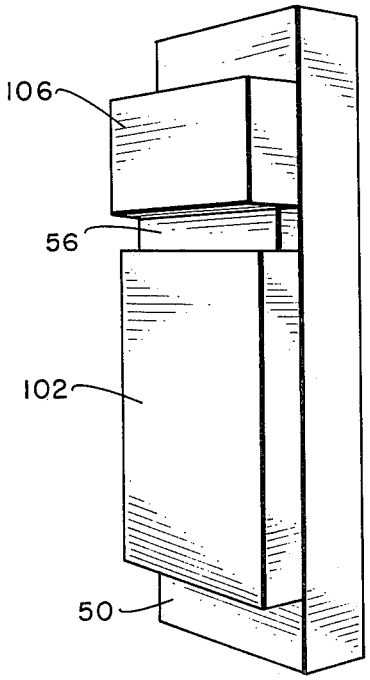
FIG. 9 illustrates the manner in which modules may be removed for maintanance and repair of the system.

The unique modular design which makes repair and maintenance relatively simple is illustrated in FIG. 9. The slide-away modular design offers unique advantages to building constructions. The three electromechanical elements of the system are self-contained, plug-in modules that easily slide in and out of the cabinet or housing 50.

The largest module is the cooling module 102 (FIG. 9) comprised of removable frame 101 supported in the cabinet or housing 50 for mounting of the cooling components. The cooling module is mounted at the lowest level because it is the largest and may be more easily handled. It can just as easily be placed at the upper level, but because of its bulk and weight would be less easy to handle. The cooling module 102 has the blower 18 and compressor 20 mounted in the first cabinet or cavity. The condensing coils 22 are mounted in the cabinet just above the blower 18, as shown in FIGS. 4 and 5. The next two cavities 24 and 28 provided by the frame are for the intake of outside and inside air respectively.

The inside air intake cavity 28 has the cooling coils 32 mounted and positioned for cooling and conditioning the air being circulated in one or more rooms. The cooling coils 32 could be mounted in a downward V similar to the condensing coils 22 so that vents could be provided in both front and back of the cabinet 50 for drawing interior air from rooms on either side of a wall position, if desired.

The control module 56 has a dual-control thermostat 58 centrally located for controlling the cooling module 102 and the heating module. The heating module 106 is comprised of blower 38 and heater 60, positioned in the mouth of the blower, mounted on the partition or plate 40. Both cooling and heating modules plug into the rear of the control module 56. The control module 56 is slideably mounted in brackets in the housing 50. Thus, for repair or maintenance of a module, the separate heating and cooling units may simply be unplugged from the control module and the module being serviced completely removed from the system.

The air circulating and heating module 56, as was mentioned above, consists of circulating blower 38 mounted on a partition 40 which slideably engages brackets in the cabinet 50 and a heater mounted on the opposite side of partition 40 from the blower 38. The heater 60 may be a resistance heater or water heater, as was described above. The heating unit exhausts into cavity 42 which has five separate sides from which output vents can be selected.

The heating module 106, the cooling module 102, or the control module 56, may be easily and readily moved from the cabinet 50 by simply removing the front panels 14 and 16 and unplugging one or more of the units from the control module 56. Thus, all the components of the cooling module 102 are readily available for repair and maintenance by simply unplugging this module and removing it from the cabinet by lifting out frame 101 without disturbing the heating and air circulating part of the system. Thus, this cooling portion of the system may be readily removed for servicing at regular intervals. Likewise, the air circulating and heating module 106 can be removed from the system for servicing and the entire unit temporarily replaced, if desired.

Another advantage of the unique modular design of the system is that the cabinet 50 may be separately installed in a building and the individual modules installed when desired. This prevents theft while construction is being completed, in addition to leaving the selection of the cooling module as an option. When desired, it can be easily added.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. A compact indoor environmental control system comprising:

an elongate thin cabinet, a removable modular air heating and circulating means slideably supported in said cabinet, a removable modular air cooling and circulating means slideably supported in said cabinet, an electric control module removably mounted in said cabinet adjacent to said heating and cooling modules, including plug means for quick connecting and disconnecting of said cooling and heating modules, said heating and cooling modules being slideably supported to provide air intake and exhaust plenums in the top, bottom, and center of said cabinet whereby said system may be installed to provide air outlet vents in any side or end of said cabinet.

2. The environmental system according to claim 1 wherein said heating module comprises:

a partition panel, a blower securely attached to said partition panel with the mouth of said blower passing through said panel, heating means secured to the opposite side of said partition in communication with the mouth of said blower, support means in said cabinet for slideably supporting said partition near the top of said cabinet whereby the mouth of said blower directs air through the heating means into the plenum at the top of said cabinet for distribution through one or more vents in the sides or end of said cabinet.

3. The environmental system according to claim 1 wherein said cooling module comprises:

a rectangular frame, a blower mounted in the bottom end of said frame with its mouth facing downward, a compressor mounted adjacent to said blower, condensing coils mounted on said frame above said blower and separating the upper portion of said frame from the lower to form an intake plenum, a cooling coil mounted in the uppermost end of said frame, partitioning means between the condensing and cooling coils separating the intake plenum into two plenums for outside air intake and inside air intake respectively, support means in said cabinet for slideably supporting said cooling modular frame above said bottom plenum with the mouth of said cooling module blower directing air into said bottom plenum for distribution through one or more vents in the sides or end of said cabinet.

4. The environmental system according to claim 3 wherein said partitioning means includes damping means for selectively connecting the inside intake plenum to draw air from the outside intake plenum.

5. The environmental system according to claim 4 wherein said damping means comprises:

a first vent connected by a duct directly to an outside air intake vent, and a second vent selectively connecting the inside intake plenum to the outside intake plenum.

* * * * *